US009115537B2

(12) United States Patent
Blair

(10) Patent No.: US 9,115,537 B2
(45) Date of Patent: Aug. 25, 2015

(54) BATTERY-POWERED ROLLER SHADE SYSTEM

(71) Applicant: Lutron Electronics Co., Inc., Coopersburg, PA (US)

(72) Inventor: Edward J. Blair, Telford, PA (US)

(73) Assignee: LUTRON ELECTRONICS CO., INC., Coopersburg, PA (US)

( * ) Notice: Subject to any disclaimer, the term of this patent is extended or adjusted under 35 U.S.C. 154(b) by 91 days.

(21) Appl. No.: 13/798,946

(22) Filed: Mar. 13, 2013

(65) Prior Publication Data

US 2014/0231032 A1 Aug. 21, 2014

Related U.S. Application Data

(60) Provisional application No. 61/765,238, filed on Feb. 15, 2013.

(51) Int. Cl.

| | |
|---|---|
| ***A47G 5/02*** | (2006.01) |
| ***E06B 9/68*** | (2006.01) |
| ***E06B 9/42*** | (2006.01) |
| ***E06B 9/72*** | (2006.01) |

(52) U.S. Cl.
CPC ... *E06B 9/68* (2013.01); *E06B 9/42* (2013.01); *E06B 9/72* (2013.01)

(58) Field of Classification Search
CPC ..... E06B 9/68; E06B 9/70; E06B 9/323; E06B 9/74
USPC ..... 160/368.1, 310, 84.02, 168.1 P, DIG. 17
See application file for complete search history.

(56) References Cited

U.S. PATENT DOCUMENTS

| | | | | |
|---|---|---|---|---|
| 2,802,523 | A | | 8/1957 | Anderle |
| 4,314,294 | A | * | 2/1982 | Riccio et al. ..... 360/96.61 |
| 4,941,000 | A | * | 7/1990 | Cardoos et al. ..... 346/145 |
| 5,134,347 | A | | 7/1992 | Koleda |
| 5,391,967 | A | | 2/1995 | Domel et al. |
| 5,467,266 | A | | 11/1995 | Jacobs et al. |
| 5,758,922 | A | * | 6/1998 | Wheatley ..... 296/100.15 |
| 5,793,174 | A | | 8/1998 | Kovach et al. |
| 5,848,634 | A | | 12/1998 | Will et al. |
| 5,883,480 | A | | 3/1999 | Domel et al. |

(Continued)

FOREIGN PATENT DOCUMENTS

| | | |
|---|---|---|
| DE | 195 38 609 A1 | 4/1996 |
| KR | 2010 0026289 A | 3/2010 |

(Continued)

*Primary Examiner* — Katherine Mitchell
*Assistant Examiner* — Johnnie A Shablack
(74) *Attorney, Agent, or Firm* — Condo Roccia Koptiw LLP

(57) ABSTRACT

A battery-powered roller shade system can include a housing that is configured to be coupled to a structure, and can include a housing body that defines an internal cavity and an access opening that extends through the housing body and into the internal cavity. The system can further include a roller tube rotatably mounted in the internal cavity, a roller shade windingly received around the roller tube, and a battery compartment positioned within the internal cavity. The battery compartment can further define an access aperture that is aligned with the access opening, such that at least one battery is removable from the battery compartment through the access aperture and through the access opening without moving the roller shade to a lowered position and without decoupling the housing from the structure.

30 Claims, 6 Drawing Sheets

(56) References Cited

U.S. PATENT DOCUMENTS

| | | | | |
|---|---|---|---|---|
| 5,990,646 | A | 11/1999 | Kovach et al. | |
| 6,057,658 | A | 5/2000 | Kovach et al. | |
| 6,181,089 | B1 | 1/2001 | Kovach et al. | |
| 6,259,218 | B1 | 7/2001 | Kovach et al. | |
| 6,369,530 | B2 | 4/2002 | Kovach et al. | |
| 6,371,192 | B1 * | 4/2002 | Anderson et al. | 160/178.1 R |
| 6,433,498 | B1 | 8/2002 | Domel et al. | |
| 6,516,858 | B1 * | 2/2003 | Anderson et al. | 160/168.1 P |
| 6,736,186 | B2 * | 5/2004 | Anderson et al. | 160/168.1 P |
| 6,812,662 | B1 | 11/2004 | Walker | |
| 6,850,017 | B1 | 2/2005 | Domel et al. | |
| 6,983,783 | B2 | 1/2006 | Carmen, Jr. et al. | |
| 7,389,806 | B2 | 6/2008 | Kates | |
| 7,401,634 | B2 | 7/2008 | Kovach et al. | |
| 7,466,090 | B2 | 12/2008 | Meewis et al. | |
| 7,517,609 | B2 * | 4/2009 | Cheng | 429/97 |
| 7,673,667 | B2 | 3/2010 | Domel et al. | |
| 7,719,215 | B2 | 5/2010 | Meewis et al. | |
| 7,723,939 | B2 | 5/2010 | Carmen, Jr. | |
| 7,839,109 | B2 | 11/2010 | Carmen, Jr. et al. | |
| 8,371,358 | B1 * | 2/2013 | Mullet et al. | 160/310 |
| 8,540,005 | B2 * | 9/2013 | Baugh et al. | 160/84.02 |
| 8,723,455 | B2 * | 5/2014 | Mullet et al. | 318/34 |
| 8,820,386 | B2 * | 9/2014 | Mullet et al. | 160/241 |
| 8,820,388 | B2 * | 9/2014 | Mullet et al. | 160/310 |
| 8,851,141 | B2 * | 10/2014 | Blair et al. | 160/84.02 |
| 2003/0168187 | A1 * | 9/2003 | Wen et al. | 160/168.1 P |
| 2008/0150461 | A1 | 6/2008 | Adamus et al. | |
| 2008/0236763 | A1 | 10/2008 | Kates | |
| 2008/0260363 | A1 | 10/2008 | Carmen, Jr. et al. | |
| 2009/0199975 | A1 * | 8/2009 | Yeh | 160/84.02 |
| 2009/0308543 | A1 | 12/2009 | Kates | |
| 2010/0269988 | A1 | 10/2010 | Mullet et al. | |
| 2011/0203748 | A1 | 8/2011 | Mullet et al. | |
| 2011/0203754 | A1 | 8/2011 | Mullet et al. | |
| 2011/0272106 | A1 | 11/2011 | Mullet et al. | |
| 2012/0031571 | A1 | 2/2012 | Mullet et al. | |
| 2012/0090797 | A1 | 4/2012 | Mullet et al. | |
| 2012/0225340 | A1 | 9/2012 | Mullet et al. | |
| 2012/0255689 | A1 * | 10/2012 | Blair et al. | 160/331 |
| 2012/0261078 | A1 * | 10/2012 | Adams et al. | 160/6 |
| 2013/0098561 | A1 * | 4/2013 | Mullet et al. | 160/29 |
| 2013/0153162 | A1 * | 6/2013 | Blair et al. | 160/310 |
| 2014/0305602 | A1 * | 10/2014 | Kirby et al. | 160/310 |

FOREIGN PATENT DOCUMENTS

| | | |
|---|---|---|
| WO | WO 2005/093682 | 10/2005 |
| WO | WO 2007/055574 | 5/2007 |
| WO | WO 2007/133450 A2 | 11/2007 |

* cited by examiner

BATTERY-POWERED ROLLER SHADE SYSTEM

CROSS REFERENCE TO RELATED APPLICATIONS

This application claims the benefit of U.S. Provisional Application Ser. No. 61/765,238 filed Feb. 15, 2013 the contents of which are hereby incorporated by reference in their entirety herein.

BACKGROUND

Typical window treatments, such as, for example, roller shades, draperies, roman shades, and venetian blinds, are mounted in front of windows to prevent sunlight from entering a space and to provide privacy. A roller shade includes a flexible shade fabric wound onto an elongated roller tube. The flexible shade fabric typically includes a weighted hembar at a lower end of the shade fabric, such that the shade fabric hangs in front of the window. Motorized roller shades include a drive system that is coupled to the roller tube to provide for tube rotation, such that the lower end of the shade fabric can be raised and lowered (i.e., moved in a vertical direction) by rotating the roller tube. Typically the drive system and roller tube are retained within a housing that is coupled to a window frame.

Batteries are now often employed to power the drive system. These batteries have been stored in either a wand that is placed external to the housing or inside the roller tube along with the drive system. An external wand is not ideal because the aesthetics of the window treatment can be diminished. Having batteries stored within the roller tube is also not ideal, because gaining access to the batteries so that the batteries can be changed is difficult. For example, in some cases the entire housing needs to be removed from the window frame to gain access to the batteries, and in other cases, the roller shade needs to be completely lowered so that an access aperture defined by the roller tube and through which the batteries are removed is exposed. As a result, some battery-powered systems lose their limits and tracking information when the batteries are changed. Therefore, in each case, changing the batteries can be burdensome.

SUMMARY

As described herein, a battery-powered roller shade system is provided in a self-contained cassette (i.e., a housing) that may be mounted, such that a covering material is able to hang in front of an opening, such as a window. The self-contained cassette of the roller shade system is easy to mount above a window frame or inside the window frame even when the window frame is shallow. The roller shade system comprises one or more batteries contained within the cassette and thus hidden from the view of a user. The roller shade system provides for easy access to the batteries to allow for replacement of the batteries without the need for any tools. The batteries may be changed while the covering material is at any position between a fully-open position and a fully-closed position. Further, replacement of the batteries does not result in the loss of tracking information of the position of the covering material.

In accordance with an embodiment, a battery-powered roller shade system can include a housing that is configured to be coupled to a structure, and can include a housing body that defines an internal cavity and an access opening that extends through the housing body and into the internal cavity. The system can further include a roller tube rotatably mounted in the internal cavity, a covering material windingly received around the roller tube such that rotation of the roller tube by a drive causes the covering material to move between a raised position and a lowered position, and a battery compartment positioned within the internal cavity. The battery compartment can include a compartment body that defines a channel configured to receive and retain at least one battery. The battery compartment can further define an access aperture that extends through the compartment body and into the channel, the access aperture being aligned with the access opening, such that the at least one battery is removable through the access aperture and through the access opening without moving the covering material to the lowered position and without decoupling the housing from the structure.

In another embodiment, a battery-powered roller shade system can include a housing that is configured to be coupled to a structure. The housing can include a housing body that has first and second sidewalls spaced from each other along a first direction, a front wall that extends along the first direction from the first sidewall to the second sidewall, and a bottom wall that extends along the first direction from the first sidewall to the second sidewall. The first and second sidewalls, front wall, and bottom wall together at least partially define an internal cavity of the housing. The bottom wall can at least partially define a door that is movable between a closed position and an open position. The system can further include a roller tube rotatably mounted in the internal cavity about an axis that extends along the first direction, a covering material windingly received around the roller tube such that rotation of the roller tube about the axis by a drive causes the covering material to move between a raised position and a lowered position, and a battery compartment positioned within the internal cavity. The battery compartment can include a compartment body that defines a channel that is elongate along the first direction and is configured to receive and retain at least one battery. Movement of the door from the closed position to the open position can form an access opening into the interval cavity such that the at least one battery can be removed from the battery compartment through the access opening when the door is in the open position.

In another embodiment, a method of changing batteries of a motorized window shade cassette that is mounted to a structure can include the steps of moving a door of a housing of the cassette from a closed position to an open position to thereby form an access opening into the housing without removing the cassette from the structure; sliding batteries stored within a battery compartment of the cassette toward an access aperture defined in the battery compartment, such that the batteries are removed from the battery compartment through the access aperture; and removing the batteries from the housing through the access opening. The sliding step can be capable of being performed when the shade fabric is in the raised position.

BRIEF DESCRIPTION OF THE DRAWINGS

The foregoing summary, as well as the following detailed description of an example embodiment of the application, will be better understood when read in conjunction with the appended drawings, in which there is shown in the drawings example embodiments for the purposes of illustration. It should be understood, however, that the application is not limited to the precise arrangements and systems shown. In the drawings.

DETAILED DESCRIPTION

Figure 1A:
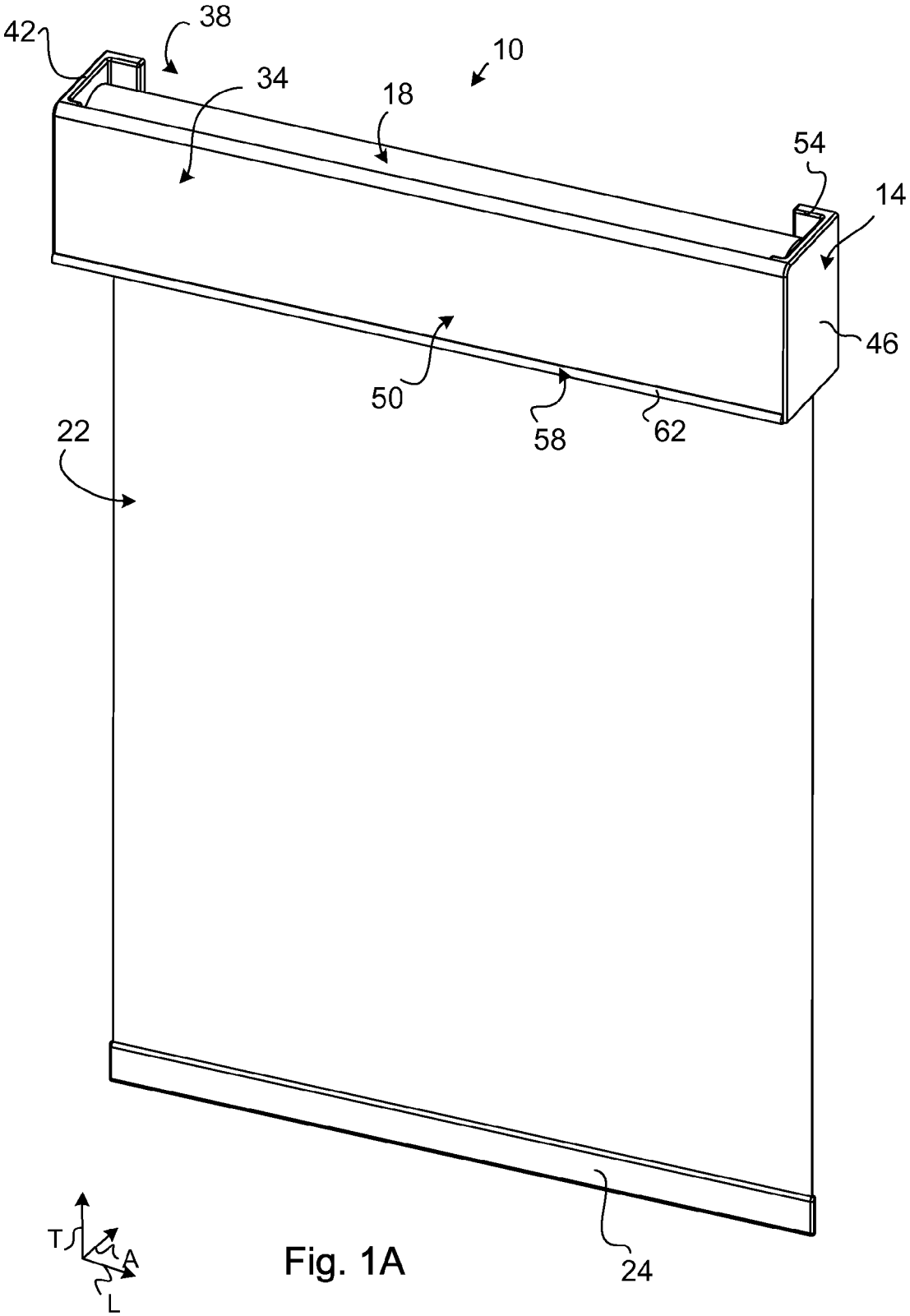
FIG. 1A is a perspective view of a battery-powered roller shade system in accordance with an embodiment, the system including a housing, a roller tube mounted within the housing, a roller shade fabric configured to be wound around the roller tube between a raised position and a lowered position, and a battery compartment within the housing but external to the roller tube, the housing including an openable door that is configured to provide access to the battery compartment.

Certain terminology is used in the following description for convenience only and is not limiting. The words "right", "left", "lower" and "upper" designate directions in the drawings to which reference is made. The words "proximally" and "distally" refer to directions toward and away from, respectively, the individual operating the display unit. The terminology includes the above-listed words, derivatives thereof and words of similar import.

Figure 1B:
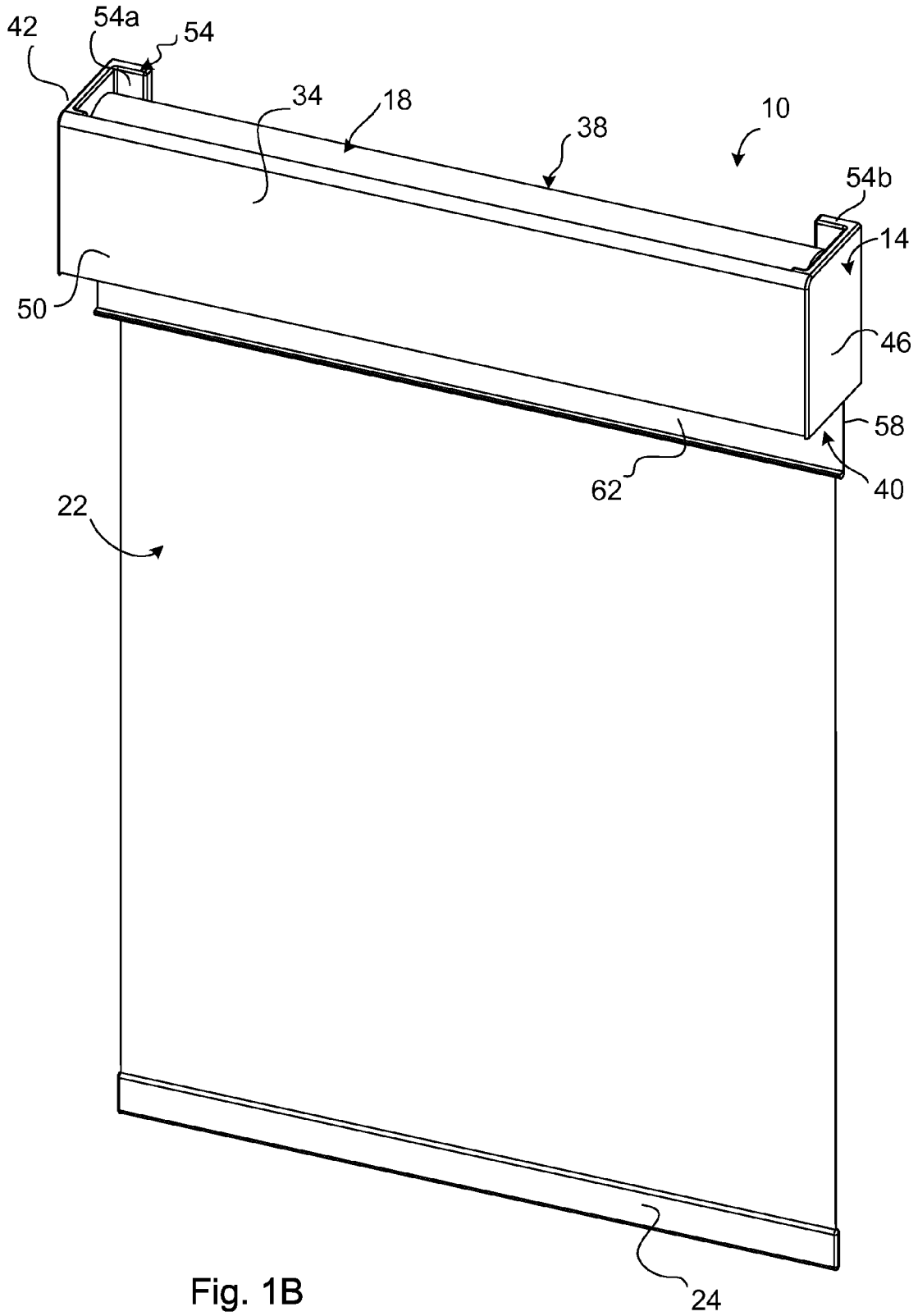
FIG. 1B is a perspective view of the system shown in FIG. 1A with the openable door in an open configuration.
Figure 2:
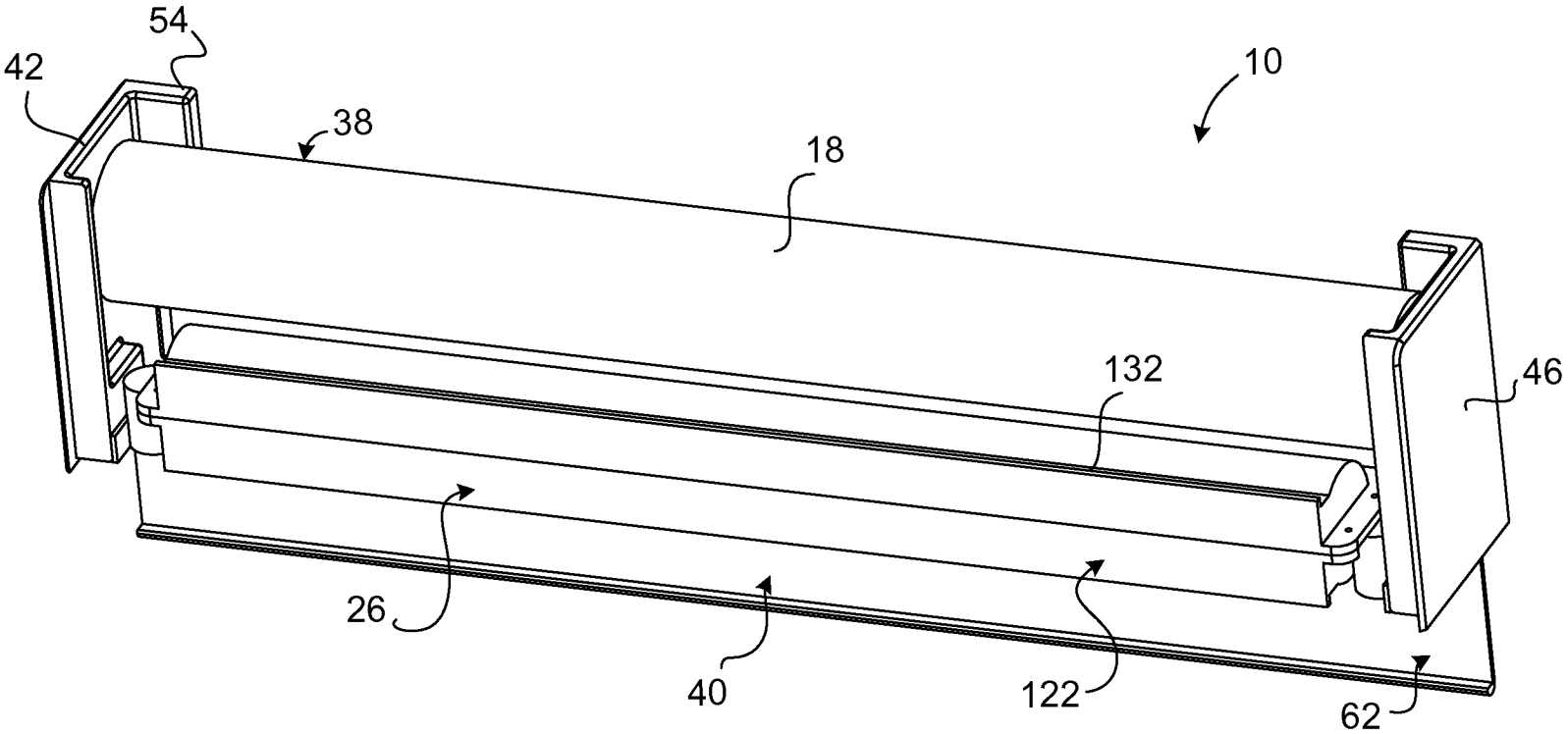
FIG. 2 is a perspective view of the system shown in FIG. 1B with a front panel of the housing removed for clarity and showing the battery compartment disposed within the housing.

Referring to FIGS. 1A, 1B, and 2, a battery-powered roller shade system 10 can include a housing 14 that is configured to be coupled to or otherwise mounted to a structure, such as a window frame, wall, or other structure as desired. The system 10 can further include a roller tube 18 that is rotatably mounted within the housing 14 and a covering material, such as a roller shade fabric 22 as illustrated, that is windingly received around the roller tube 18 such that rotation of the roller tube 18 causes the roller shade fabric 22 to move between a raised position as shown in FIG. 2 and a lowered position as shown in FIG. 1A. In particular, the roller shade fabric 22 can include a first or top end that is coupled to the roller tube 18 and a second or bottom end that is coupled to a hembar 24, such that rotation of the roller tube 18 causes the hembar 24 to move toward or away from the housing 14. The housing 14 can be made of a metal material, as desired. It should be appreciated, however, that the housing 14 can be made from any material as desired, or from any combination of materials a desired. It should also be appreciated, that the covering material can be any material as desired. For example, the covering material can be "scrim," woven cloth, non-woven material, light-control film, screen, or mesh.

The roller shade system 10 can further include a drive system such as a motor drive unit 15 that is mounted inside the housing 14 and at least partially within the roller tube 18. The motor drive unit can be configured to allow for control of the rotation of the roller tube 18 by a user of the roller shade system so that the user can move the roller shade fabric 22 to a desired position. The motor drive unit can include a sensor that monitors the position of the roller shade fabric 22 so that the motor drive unit knows the position of the roller shade relative to the upper and lower limits of the roller shade at any given time. Further, the motor drive unit can be manually controlled (e.g. with a push button) and/or wirelessly controlled (e.g. with an infrared (IR) or radio frequency (RF) remote). Therefore, the motor drive unit may further include an RF transceiver or receiver, and an antenna that may be enclosed within the housing or coupled to an exterior portion of the housing. Examples of motor drive units for motorized roller shades are described in greater detail in U.S. Pat. No. 6,983,783, issued Jan. 10, 2006, entitled MOTORIZED SHADE CONTROL SYSTEM; U.S. Pat. No. 7,723,939, issued May 25, 2010, entitled RADIO-FREQUENCY CONTROLLED MOTORIZED ROLLER SHADE; and U.S. Pat. No. 7,839,109, issued Nov. 23, 2010, entitled METHOD OF CONTROLLING A MOTORIZED WINDOW TREATMENT, the entire contents of each of which are hereby incorporated by reference herein. It should be appreciated, however, that any motor drive unit or drive system can be used to control the roller tube 18.

As shown in FIG. 2, the system 10 can further include a battery compartment 26 that is positioned within the housing 14. The battery compartment 26 can be configured to retain at least one battery, such as a plurality of batteries 30 that are electrically coupled to the drive system to thereby supply power to the drive system. The system 10, and in particular the housing 14 and the battery compartment 26 can be configured so as to provide easy access to the batteries 30 so that the batteries 30 can be easily changed. For example, the housing 14 and the battery compartment 26 can be configured such that the batteries 30 can be removed and subsequently replaced without having to decouple the housing 14 from the structure and/or move the roller shade fabric 22 to the lowered position.

The system 10 can be customized to have any desired size, shape, and/or aesthetic look. The system 10 can be configured to have an internal mount (e.g. mounted within a window frame) or an external mount (e.g. mounted to the wall above the window frame). It should be appreciated, however, that the system 10 can be configured to have any type of mount as desired. Further, because all of the components of the system 10, such as the roller tube 18, the roller shade fabric 22, and the battery compartment 26 are housed within the housing 14, the roller shade system 10 can form a self-contained unit and be referred to as a customizable window shade cassette.

With continued reference to FIGS. 1A and 1B, the housing 14 can include a housing body 34 that is elongate along a first direction L and defines an internal cavity 38. The housing 14 can further define an access opening 40 that extends through housing body 34 and into the internal cavity 38. The battery compartment 26 can be positioned in the internal cavity 38 such that the batteries 30 can be removed through the access opening 40.

The housing body 34 can have first and second sidewalls 42 and 46 that are spaced from each other along the first direction L, a front wall 50 that extends along the first direction form the first sidewall 42 to the second sidewall 46, a back wall 54 that is spaced from the front wall along a second direction A that is perpendicular to the first direction L, and a bottom wall 58 that extends along the first direction L from the first sidewall 42 to the second sidewall 46. As shown in FIG. 1A, the back wall 54 can include a first back portion 54*a* that extends from the first sidewall 42 along the first direction L and a second back portion 54*b* that extends from the second sidewall 46 along the first direction L and toward the first back portion 54*a* such that the first back portion 54*a* is spaced from the second back portion 54*b* along the first direction L. The housing 14 can be configured to be mounted to the structure by the first and second back portions 54*a* and 54*b* or the first and second sidewalls 42 and 46. It should be appreciated, however, that the housing 14 can be mounted to the structure by any portion of the housing 14 as desired. For example, the housing 14 can further include a top wall that is spaced from the bottom wall 58 along a third direction T that is perpendicular to both the first and second directions and the housing 14 can be mounted to the structure by the top wall. Further it should be appreciated, that while the back wall 54 is separated into first and second back portions 54*a* and 54*b*, the back wall 54 can be of a single piece construction and can extend from the first sidewall 42 to the second sidewall 46, as desired.

The first and second sidewalls 42 and 46, front wall 50, back wall 54 and bottom wall 58 can at least partially define the internal cavity 38 of the housing 14, and one of the bottom wall 58 and the front wall 50 can at least partially define a door 62 that is movable between a closed position and an open position. When the door 62 is in the open position the access opening 40 can be defined and when the door 62 is in the closed position the access opening 40 can be removed or otherwise obscured. Therefore, the roller tube 18 and the battery compartment 26 can be substantially hidden from view when the door 62 is in the closed position, and at least a portion of the battery compartment 26 can be exposed when the door 62 is in the open position, such that the access opening 40 provides access to the batteries 30 retained by the battery compartment 26. It should be appreciated, however, that the housing body 34 can be void of a door 62 such that the access opening 40 can be defined at all times without movement of any portions of the bottom or front walls 58 and 50 to an open position.

Figure 3A:
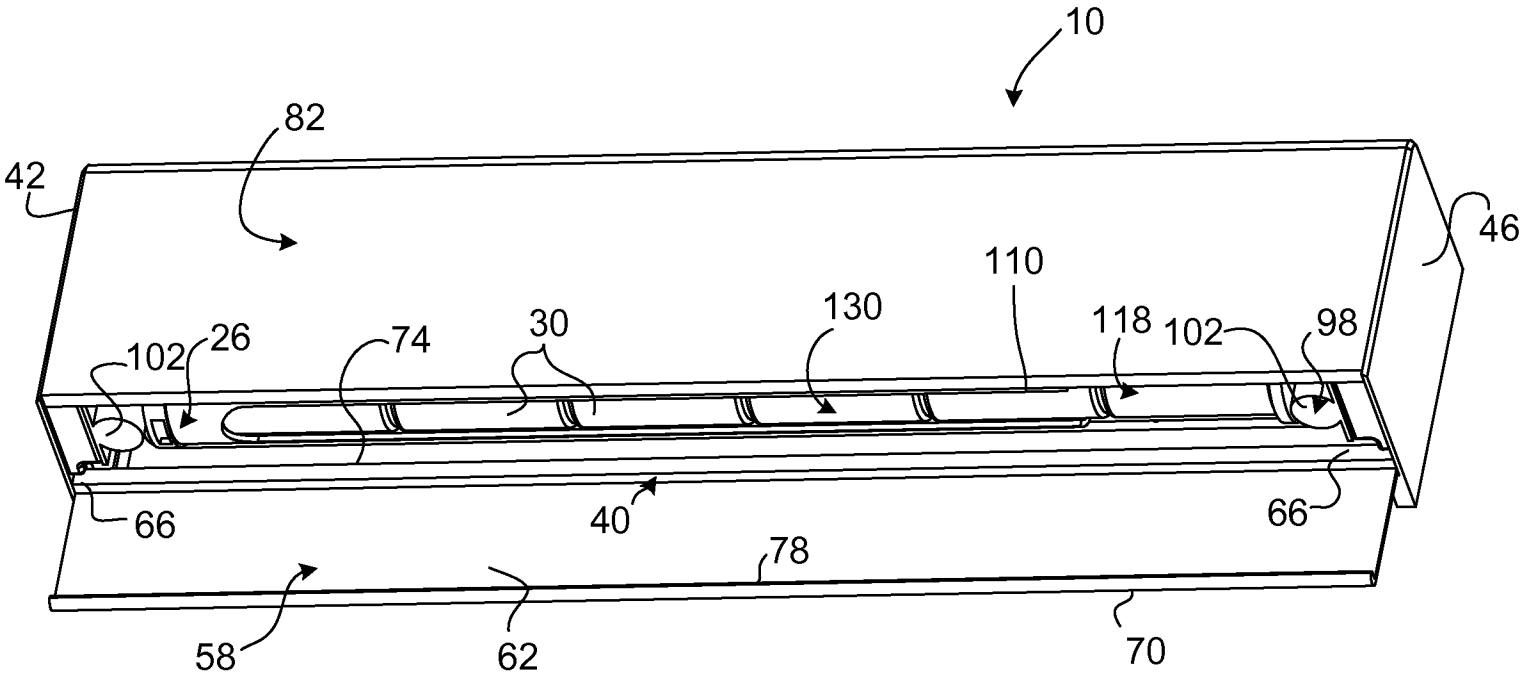
FIG. 3A is a bottom perspective view of the system shown in FIG. 1B with the door in an open configuration and the roller shade fabric in the raised position.
Figure 3B:
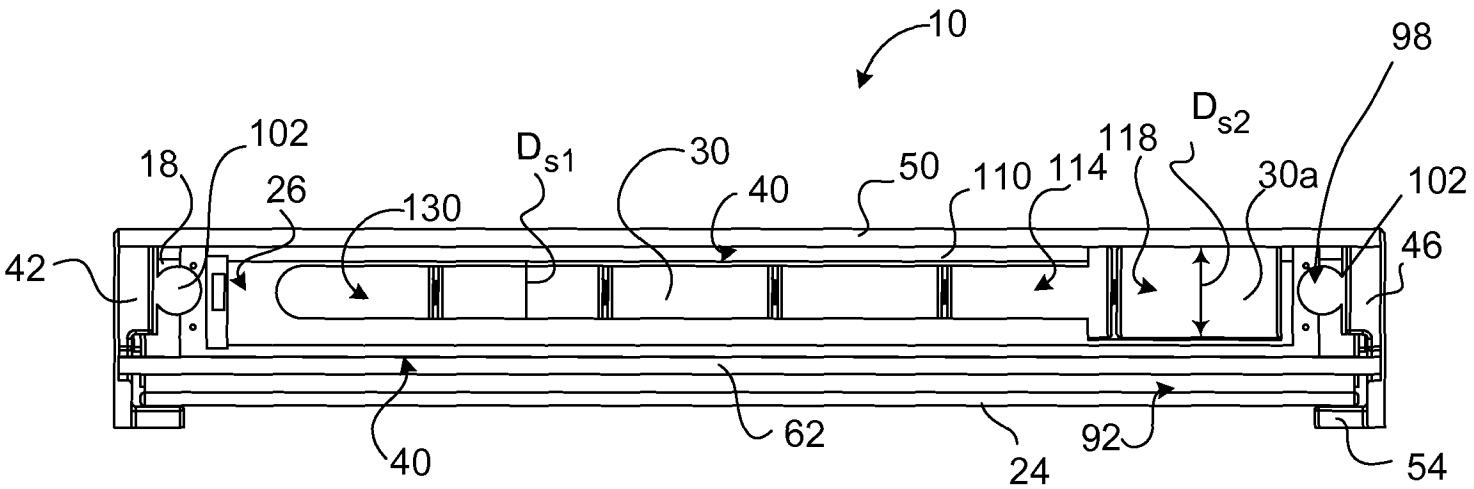
FIG. 3B is a bottom plan view of the system shown in FIG. 3A.

In the illustrated embodiment and as shown in FIGS. 2, 3A, and 3B, the entire bottom wall 58 defines the door 62 such that the door 62 extends from the first sidewall 42 to the second sidewall 46. As shown in FIG. 3A, the door 62 is coupled to the first and second sidewalls 42 and 46 by respective hinge portions 66 such that the door 62 pivots about the hinge portions 66 (e.g. a pivot axis that extends along the first direction L) when the door 62 is moved between the closed and open positions. The hinge portions 66 can be separate portions that are spaced from each other along the first direction L as illustrated, or the hinge portions 66 can be portions of a single hinge that spans from the first sidewall 42 to the second sidewall 46. It should be appreciated, however, that the hinge portions 66 can have any configuration as desired. For example, the hinge portions 66 can be oriented such that the door 62 pivots about a pivot axis that extends along the second direction A, as desired.

It should also be appreciated, that the door 62 can have other configurations as desired. For example, the door 62 may not extend for the entire distance between the first sidewall 42 to the second sidewall 46. Additionally, the door 62 can be removably coupled to a fixed portion of the housing body 34 such that the entire door 62 is removed from and spaced from the fixed portion when the door 62 is moved to the open position. Further, the door 62 can be configured such that a first portion of the bottom wall 58 or front wall 50 is fixed while the door 62 is slidable along the first direction relative to the first fixed portion. That is, the door 62 can be configured to slide, rather than pivot or be removed, relative to a fixed portion of the housing.

Figure 3C:
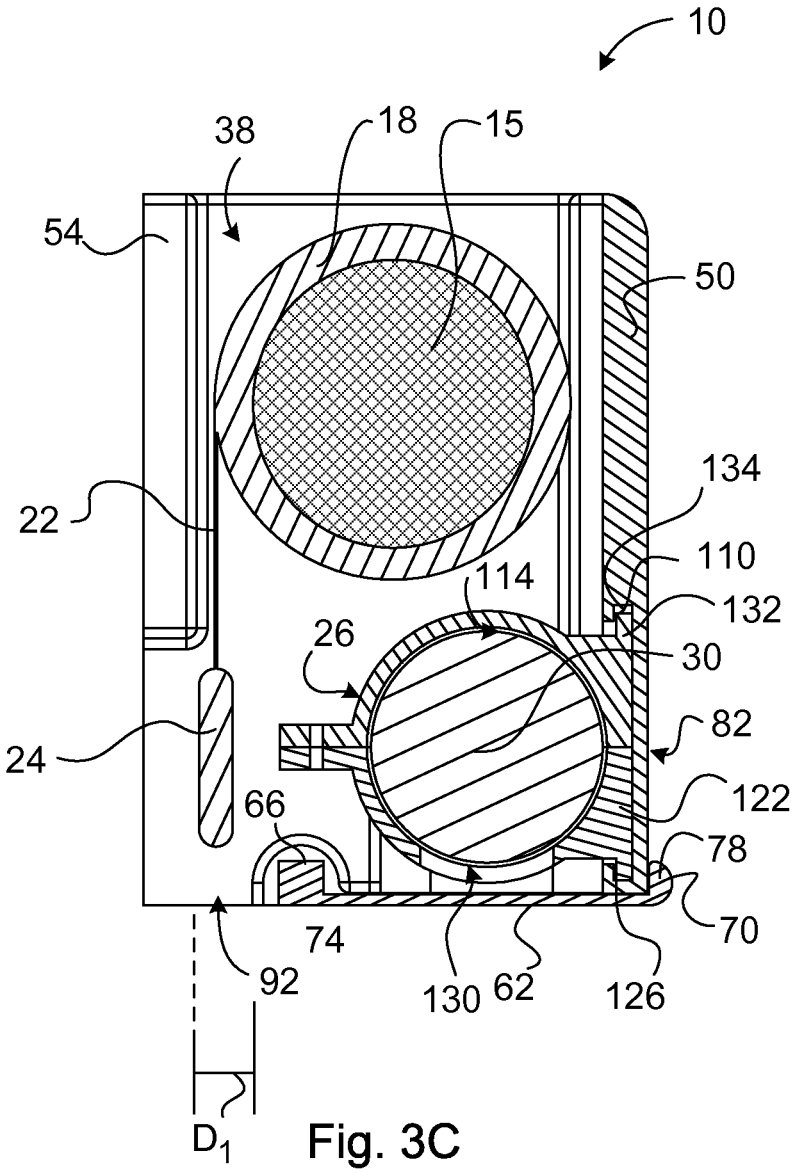
FIG. 3C is a side cross-sectional view of the system shown in FIG. 3A with the door in the closed configuration.

As shown in FIGS. 3B and 3C, the bottom wall 58 defines a front side 70 and a back side 74 that is spaced from the front side along the second direction A. The front side 70 can define an upstanding lip 78 that is configured to engage a front face 82 of the front wall 50 when the door 62 is in the closed position as shown in FIG. 3C. The back side 74 of the bottom wall 58 can define the hinge portions 66 and can be spaced from the back wall 54 along the second direction so as to define a gap 92 between the bottom wall 58 and the back wall 54 through which the roller shade fabric 22 can move. The gap 92 can define a distance $D_1$ measured along the second direction A that is sufficient to allow the hembar 24 and the roller shade fabric 22 to move between the raised and lowered positions. For example, the distance $D_1$ can be between about 0.5 inches and about 1.5 inches. It should be appreciated, however, that the gap 92 can have any distance $D_1$ as desired so long as the roller shade fabric 22 can move. It should be appreciated, that the gap 92 can be defined anywhere between the back wall 54 and the front wall 50. For example, the gap 92 could be defined between the front side 70 of the bottom wall 58 and the front wall 50, as desired.

In embodiments, where the access opening 40 is defined without moving a door 62 to an open position, the batteries 30 could be removed through the gap 92. Therefore, in such embodiment, the gap 92 can also be said to define the access opening 40 into the internal cavity 38. It should be appreciated, however, that housing 14 can define a second gap that is separate from the gap 92 and the second gap can define the access opening 38, as desired.

With continued reference to FIGS. 3A and 3B, the housing 14 can further include at least one coupling member 98 that is coupled to the housing body 34 within the internal cavity 38. The at least one coupling member 98 can be configured to retain the door 62 in the closed position. In the illustrated embodiment, the at least one coupling 98 includes a pair of magnets 102 that couple to the door 62 when the door 62 is in the closed position. In particular, the magnets 102 attract to a metal portion, such as respective metal portions of the door 62 when the door 62 is in the closed position. As shown in FIG. 3B, each magnet 102 is coupled to a respective one of the first and second sidewalls 42 and 46 and the magnets 102 are spaced from each other along the first direction. It should be appreciated, however, that the at least one coupling member 98 can have any configuration as desired. For example, the at least one coupling member 98 can be configured as a latch.

As shown in FIGS. 2 and 3B, the roller tube 18 can be rotatably coupled to the first and second sidewalls 42 and 46 and can rotate about an axis that extends along the first direction between the first and second sidewalls 42 and 46. As shown in FIG. 3C, the roller tube 18 can be positioned in the internal cavity 38 proximate to an upper end of the internal cavity 38. The roller shade fabric 22 can be coupled to the roller tube 18 such that the hembar 24 is positioned relative to a back end of the roller tube 18. Therefore, when the roller tube 18 rotates clockwise about the axis the roller shade fabric 22 will move toward the raised position and when the roller tube 18 rotates counterclockwise the roller shade fabric 22 will move toward the lowered position. It should be appreciated, however, that the roller tube 18 can be configured such that the hembar 24 is positioned relative to a front end of the roller tube 18 such that when the roller tube 18 rotates clockwise about the axis the roller shade will move toward the lowered position.

With continued reference to FIGS. 2A-3C, the battery compartment 26 is positioned within the internal cavity 38 and includes a compartment body 110 that defines a channel 114 configured to receive and retain the at least one battery 30. The battery compartment 26 can be positioned below the roller tube 18 as illustrated. It should be appreciated, however, that the battery compartment 26 can be positioned alongside the roller tube 18 such as in front of the roller tube 18 so that the battery compartment 26 is between the front wall 50 and the roller tube 18. The battery compartment 26 can further define an access aperture 118 that extends through the compartment body 110 and into the channel 114. As shown in FIG. 3C, the access aperture 118 can be aligned with the access opening 40, such that the at least one battery 30 is removable through the access aperture 118 and through the access opening 40 without moving the roller shade fabric 22 to the lowered position and without decoupling the housing 14 from the structure.

As shown in FIG. 3C, battery compartment 26 can be coupled to the front wall 50 of the housing body 34. As shown, the battery compartment 26 can include a mating member 122 that extends from the battery compartment body 110. The mating member 122 can be configured to mate with a mating member 126 defined by the front wall 50. As shown in FIG. 3C, the mating member 122 can define a T-shape protrusion 132 and the mating member 126 can define a T-shaped slot 134 that receives the protrusion 132 along the first direction to thereby couple the battery compartment 26 to the front wall 50. The slot 134 can extend along a major portion of the front wall 50 along the first direction L. Therefore the protrusion 132 can be slid into the slot 134 along the first direction to thereby couple the battery compartment 26 to the front wall 50. It should be appreciated, however, that the battery compartment 26 can be coupled to any portion of the housing 14 as desired. For example, the battery compartment 26 can be coupled to the first and second sidewalls 42 and 46, the back wall 54 or even the bottom wall 58. It should also be appreciated that the battery compartment 26 can be coupled to the door 62 such that when the door 62 is moved to the open position the battery compartment 26 moves with the door 62 and through the access opening 40.

Now in reference to FIG. 3B, the compartment body 110 is elongate along the first direction between the first and second sidewalls 42 and 46. As shown in FIG. 3B, the battery compartment 26 can further define a slot 130 that extends through the battery compartment body 110 and into the channel 114. The slot 130 can extend along a substantial portion of the compartment body 110 along the first direction and toward the access aperture 118. For example, the slot 130 can extend along the entire length of the channel 114. In the illustrated embodiment, the slot 130 merges with the access aperture 118 so as to define a continuous slot. It should be appreciated, however, that the slot 130 can terminate short of the access aperture 118 or that the slot 130 and the access aperture 118 can be angularly offset with respect to each other, as desired. Further while the illustrated embodiment shows the slot 130 and access aperture 118 extending through a bottom of the compartment body 110, the slot 130 and the access aperture 118 can extend through other portions of the compartment body 110, as desired. For example, the slot 130, the access aperture 118 or both can extend through a front or back side of the compartment body 110 as desired.

With continued reference to FIG. 3B, the slot 130 can have a first dimension $D_{S1}$ measured along the second direction A and the access aperture 118 can have a second dimension $D_{S2}$ that is also measured along the second direction and is greater than the first dimension $D_{S1}$. The first dimension $D_{S1}$ can be less than a diameter of the at least one battery 30 and the second dimension $D_{S2}$ can be greater than the diameter of the at least one battery 30. Therefore, when the at least one battery 30 is to be removed from the battery compartment 26 an individual can insert their finger through the slot 130 and engage the battery 30 to thereby slide the battery 30 toward the access aperture 118. Once the battery 30 is over the access aperture 118 the battery 30 will fall or otherwise be capable of being removed from the channel 114 through the access aperture 118. The first dimension $D_{S1}$ can be between about 0.5 inches and about 1.0 inch and the second dimension $D_{S2}$ can be between about 1.25 inches and about 1.38 inches. It should be appreciated, however, that the slot 130 and the access aperture 118 can have any dimensions as desired.

When the channel 114 of the battery compartment 26 is completely filled with the batteries 30, a last battery 30*a* may be retained within the channel 114 over the access aperture 118. The last battery 30*a* is prevented from falling out of the channel 114 through the access aperture 118 because of a retention force provided by the batteries within the channel 114. That is, the batteries 30 are pressed together while in the channel 114 such that each battery applies a force against an adjacent battery 30. This force is strong enough to retain the last battery 30*a* within the channel 114. It should be appreciated, however, that the battery compartment 26 can include a movable door that selectably covers the access aperture 118 to prevent the last battery 30*a* from falling through the access aperture.

The roller shade system 10 can be customized to correspond to any window as desired. Once the roller shade system 10 has been installed, the batteries 30 that are used to power the roller shade system can be easily replaced when new batteries are required. For example, if the batteries 30 are completely drained the door 62 can be moved to the open position and the batteries can be slid within the channel 114 of the battery compartment 26 and toward the access aperture 118 of the battery compartment 26. At the access aperture 118 the batteries 30 can be removed from the battery compartment 26 and subsequently removed from the housing 14 through the access opening 40 without interference from the housing 14, the roller tube 18, and the roller shade fabric 22. It should be appreciated, however, that if the battery compartment 26 is coupled to the door 62, the batteries 30 will pass through the access opening 40 of the housing 14 prior to being removed from the battery compartment 26. In each embodiment, the batteries 30 can be removed from the housing 14 without decoupling the housing 14 from the window. Moreover, the batteries 30 can be removed from the housing 14 regardless of the position of the roller shade fabric 22. Therefore, the batteries 30 can be removed from the housing 14 whether the roller shade is in the lowered position, the raised position, or somewhere in between the lowered and raised positions. Because the roller shade fabric 22 does not have to be moved to the lowered position to remove the batteries 30, the motor drive unit can properly maintain tracking information of the position of the roller shade fabric 22 after the batteries 30 have been replaced.

While the foregoing description and drawings represent the preferred embodiment of the present invention, it will be understood that various additions, modifications, combinations and/or substitutions may be made therein without departing from the spirit and scope of the invention as defined in the accompanying claims. In particular, it will be clear to those skilled in the art that the invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components, which are particularly adapted to specific environments and operative requirements without departing from the principles of the invention. In addition, features described herein may be used singularly or in combination with other features. For example, features described in connection with one component may be used and/or interchanged with features described in another component. The presently disclosed embodiment is therefore to be considered in all respects as illustrative and not restrictive, the scope of the invention being indicated by the appended claims, and not limited to the foregoing description.

It will be appreciated by those skilled in the art that various modifications and alterations of the invention can be made without departing from the broad scope of the appended claims. Some of these have been discussed above and others will be apparent to those skilled in the art.

What is claimed:

1. A battery-powered roller shade system comprising:

a housing that is configured to be coupled to a structure, the housing including a housing body that defines an internal cavity, the housing further defining an access opening that extends through a bottom of the housing body and into the internal cavity;

a roller tube rotatably mounted in the internal cavity;

a covering material windingly received around the roller tube such that rotation of the roller tube by a drive causes the covering material to move between a raised position and a lowered position; and a battery compartment positioned within the internal cavity, the battery compartment including a compartment body that defines a channel configured to receive and retain at least one battery, the battery compartment further defining an access aperture that extends through the compartment body and into the channel, the access aperture being aligned with the access opening, such that the at least one battery is removable through the access aperture and through the access opening without moving the covering material to the lowered position and without decoupling the housing from the structure, wherein when the battery compartment is filled and the at least one battery is positioned over the access aperture, the battery compartment retains the at least one battery in the channel and prevents the at least one battery from falling out of the battery compartment.

2. The battery-powered roller shade system of claim 1, wherein the battery compartment is positioned below the roller tube.

3. The battery-powered roller shade system of claim 1, wherein the at least one battery is removable through the access aperture and through the access opening while the covering material is in any position between the raised position and the lowered position.

4. The battery-powered roller shade system of claim 1, wherein the at least one battery comprises a plurality of batteries, and wherein when the plurality of batteries are disposed in the channel, the battery compartment prevents a last battery of the plurality of batteries that is positioned over the access aperture from falling through the access aperture.

5. The battery-powered roller shade system of claim 1, wherein the housing body includes first and second side walls that are spaced from each other along a first direction, a front wall that extends along the first direction from the first side wall to the second side wall, a back wall that is spaced from the front wall along a second direction that is perpendicular to the first direction, and a bottom wall that extends along the first direction from the first side wall to the second side wall, at least a portion of the bottom wall defining a door that is movable between a closed position and an open position whereby the access opening is defined when the door is in the open position.

6. The battery-powered roller shade system of claim 5, wherein the back wall includes a first back portion that extends from the first side wall along the first direction and a second back portion that extends from the second side wall along the first direction, the first back portion being spaced from the second back portion along the first direction.

7. The battery-powered roller shade system of claim 5, wherein the door extends from the first side wall to the second side wall.

8. The battery-powered roller shade system of claim 7, wherein the door is coupled to the first and second side walls by respective hinge portions such that the door pivots about the hinge portions when the door is moved between the closed and open positions.

9. The battery-powered roller shade system of claim 8, wherein the hinge portions are spaced from the back wall along the second direction to thereby define a gap through which the covering material moves.

10. The battery-powered roller shade system of claim 8, further comprising at least one coupling member coupled to the housing body within the internal cavity, the at least one coupling member being configured to retain the door in the closed position.

11. The battery-powered roller shade system of claim 10, wherein the at least one coupling member is a pair of magnets.

12. The battery-powered roller shade system of claim 8, wherein the battery compartment is coupled to the front wall.

13. The battery-powered roller shade system of claim 12, wherein the compartment body is elongate along the first direction between the first and second side walls, the battery compartment further defining a slot that extends through the body and into the channel, the slot extending along a substantial portion of the compartment body along the first direction and toward the access aperture.

14. The battery-powered roller shade system of claim 13, wherein the slot has a first dimension measured along the second direction, and the access aperture has a second dimension measured along the second direction that is greater than the first dimension.

15. The battery-powered roller shade system of claim 14, wherein the first dimension is less than a diameter of the at least one battery and the second dimension is greater than the diameter of the at least one battery.

16. A battery-powered roller shade system comprising:

a housing that is configured to be coupled to a structure, the housing including a housing body that has first and second sidewalls spaced from each other along a first direction, a front wall that extends along the first direction from the first sidewall to the second sidewall, and a bottom wall that extends along the first direction from the first sidewall to the second sidewall, the first and second sidewalls, front wall, and bottom wall at least partially defining an internal cavity of the housing, the bottom wall at least partially defining a door that is movable between a closed position and an open position;

a roller tube rotatably mounted in the internal cavity about an axis that extends along the first direction;

a covering material windingly received around the roller tube such that rotation of the roller tube about the axis by a drive causes the covering material to move between a raised position and a lowered position;

a battery compartment positioned within the internal cavity, the battery compartment including a compartment body that defines a channel that is elongate along the first direction and is configured to receive and retain at least one battery, wherein movement of the door from the closed position to the open position forms an access opening into the interval cavity at a bottom of the housing, through which the at least one battery can be removed from the battery compartment, wherein when the door is moved from the closed position to the open position, the battery compartment prevents the at least one battery from falling out of the battery compartment.

17. The battery-powered roller shade system of claim 16, wherein the battery compartment is coupled to the front wall.

18. The battery-powered roller shade system of claim 16, wherein the battery compartment is positioned below the roller tube.

19. The battery-powered roller shade system of claim 16, further comprising at least one coupling member coupled to the housing body within the internal cavity, the at least one coupling member being configured to retain the door in the closed position.

20. The battery-powered roller shade system of claim 19, wherein the at least one coupling member is a pair of magnets.

21. The battery-powered roller shade system of claim 16, wherein the housing body further includes a back wall that is spaced from the front wall along a second direction that is perpendicular to the first direction.

22. The battery-powered roller shade system of claim 21, wherein the door is coupled to the first and second side walls by respective hinge portions such that the door pivots about the hinge portions when the door is moved between the closed and open positions.

23. The battery-powered roller shade system of claim 21, wherein the back wall includes a first back portion that extends from the first side wall along the first direction and a second back portion that extends from the second side wall along the first direction, the first back portion being spaced from the second back portion along the first direction.

24. The battery-powered roller shade system of claim 23, wherein the hinge portions are spaced from the back wall along the second direction to thereby define a gap through which the covering material moves.

25. The battery-powered roller shade system of claim 16, wherein the battery compartment further defines an access aperture that extends through the compartment body and into the channel, the access aperture being aligned with the access opening, such that the at least one battery is removable through the access aperture and through the access opening without moving the covering material to the lowered position and without decoupling the housing from the structure.

26. The battery-powered roller shade system of claim 25, wherein the at least one battery is removable through the access aperture and through the access opening while the covering material is in any position between the raised position and the lowered position.

27. The battery-powered roller shade system of claim 25, wherein when the battery compartment is filled and the at least one battery is positioned over the access aperture, the battery compartment prevents the at least one battery from falling out of the channel through the access aperture.

28. The battery-powered roller shade system of claim 25, wherein the compartment body further defines a slot that extends through the body and into the channel, the slot extending along a substantial portion of the compartment body along the first direction and toward the access aperture.

29. The battery-powered roller shade system of claim 28, wherein the slot has a first dimension measured along a second direction that is perpendicular to the first direction, and the access aperture has a second dimension measured along the second direction that is greater than the first dimension.

30. The battery-powered roller shade system of claim 29, wherein the first dimension is less than a diameter of the at least one battery and the second dimension is greater than the diameter of the at least one battery.

* * * * *